US005819752A

United States Patent [19]

Steele

[11] Patent Number: 5,819,752

[45] Date of Patent: Oct. 13, 1998

[54] ANATOMICALLY CORRECT MOUTHPIECE

[75] Inventor: William P. Steele, 5928 Yorkshire, Detroit, Mich. 48224

[73] Assignees: William P. Steele, Detroit; Peter D. Keefe, Roseville, both of Mich.

[21] Appl. No.: 840,388

[22] Filed: Apr. 29, 1997

[51] Int. Cl.[6] ..... A24F 5/00

[52] U.S. Cl. ..... 131/227; 131/229; 131/331

[58] Field of Search ..... 131/331, 207, 131/173, 187, 180, 181, 191, 227, 229, 361; D27/163, 169, 170; 128/206.29

[56] References Cited

U.S. PATENT DOCUMENTS

| | | | |
|---|---|---|---|
| 3,978,981 | 9/1976 | Musick | 131/227 |
| 4,711,254 | 12/1987 | Fleisher et al. | 131/227 |
| 5,433,224 | 7/1995 | Luke et al. . | |

FOREIGN PATENT DOCUMENTS

| | | | |
|---|---|---|---|
| 0380324 | 1/1990 | European Pat. Off. | 131/227 |
| 3148797 | 6/1991 | Japan | 131/227 |

*Primary Examiner*—John G. Weiss
*Assistant Examiner*—Charles W. Anderson
*Attorney, Agent, or Firm*—Peter D. Keefe

[57] ABSTRACT

A mouthpiece for smoking instruments which is structured to be anatomically correct, in that it is structurally compatible with the mouth parts of a user when the mouthpiece is situated in the user's mouth to one side thereof. The mouthpiece is a laterally asymmetrical structure which conforms to the shape of the side of the mouth. The tip is acutely angled in relation to the mouthpiece axis which lateral asymmetry locates the tip so that it does not interferingly affront the tongue and cheek thereby increasing comfort and teeth feel and the port of the tip is directed toward the tongue cavity thereby making inhalation easier and more efficient. The mouthpiece is vertically symmetrical so that by simply inverting the mouthpiece, it can be placed comfortably at either side of a user's mouth. The mouthpiece is preferred to include a groove adjacent the end for interfacingly receiving with the tips of the smoker's teeth. It is further preferred to provide the mouthpiece with a concave recess on the side thereof opposite the tip for comfortably interfacing with the user's lip and cheek at the side of the mouth.

21 Claims, 2 Drawing Sheets

ANATOMICALLY CORRECT MOUTHPIECE

BACKGROUND OF THE INVENTION

1. Field of the Invention

The present invention relates to mouthpieces, particularly those used for smoking instruments, inclusive of holders of cigars and cigarettes and pipes. More particularly, the present invention relates to an anatomically correct mouthpiece, especially an anatomically correct mouthpiece for smoking instruments.

2. Description of the Prior Art

Smoking has been enjoyed, for better or worse, for many centuries. Smoking instruments have been developed to increase smoking enjoyment, such as for example cigar and cigarette holders and pipes. While cigarettes are usually smoked by an end thereof being directly placed in the smoker's mouth, wherein the cigarette end may or may not have a filter integral with the cigarette, some smokers of cigarettes prefer to place the end of the cigarette into a receptacle of a holder, and then place the conventional mouthpiece of the holder into his or her mouth. Cigars are more frequently smoked using a holder, wherein, similarly, an end of the cigar is received into the receptacle of the holder and the conventional mouthpiece thereof is placed into the smoker's mouth. Pipes have stems which terminate at their distal end in a conventional mouthpiece which is placed into the smoker's mouth. It is known in the art to provide cigar holders with removable conventional mouthpieces either by threads or a frictional interfit therebetween, as it is also known to make removable conventional mouthpieces for pipes, preferably by a frictional interfit therebetween.

FIG. 1A and 1B depict an example of a prior art cigar holder 10. The conventional mouthpiece 12 thereof has features common to the conventional mouthpieces of cigarette holders and pipes. The cigar holder 10 has a body 10*a* which has a receptacle 14 at one end for receiving thereinto the end of a cigar. The opposite end of the cigar holder 10 has the conventional mouthpiece 12. The conventional mouthpiece 12 has a tip 16 which is oriented perpendicular to a mouthpiece axis Z. The tip 16 is symmetrical along the lateral axis X and is symmetrical along the vertical axis Y, wherein the lateral and vertical axes X, Y are perpendicular to the mouthpiece axis Z. Consequently, the port 18 introduces smoke into the smoker's mouth along the mouthpiece axis Z. Consequently further, the left and right sides L, R of the tip 16 press against the tongue and the cheek in an uncomfortable manner when the conventional mouthpiece is situated at either side of the smoker's mouth, whereat the teeth do not bite thereupon with a good fit or feel. Generally speaking, prior art cigarette holders and pipes have mouthpieces more-or-less shaped like FIGS. 1A and 1B, wherein the tip is at ninety degrees to the mouthpiece axis.

It is, therefore, clear that the conventional mouthpiece is anatomically incorrect for a smoker to smoke with the conventional mouthpiece situated at either side of his or her mouth. Indeed, a conventional mouthpiece is only anatomically correct if it is placed at the center of the mouth, ie., at the front teeth and extending straight outward from the face. However, a conventional mouthpiece is not really anatomically correct for practical reasons. The reason for this is that smokers do not smoke with the mouthpiece at the center of the mouth. Smokers tend to want to place the conventional mouthpiece to one side of the mouth, where it is more conducive to the pleasure of smoking in that the smoker can talk, take a breath, and so on, even as the conventional mouthpiece is in his or her mouth. Problematically, because the conventional mouthpiece has a fully symmetrical tip (ie., laterally and vertically symmetrical along respective X and Y axes), when the conventional mouthpiece is placed at a side of the mouth a corner of the tip will inevitably press against the smoker's tongue and cheek and the teeth will not mesh well with the tip, which sensations are quite uncomfortable. Further, it is simply unnatural for a smoker to smoke having the conventional mouthpiece at the front teeth.

Accordingly, what is needed in the art is a mouthpiece which is structured to be anatomically compatible with the mouth parts of a smoker when the mouthpiece is situated in his or her mouth to one side thereof. That is, what is needed is an anatomically correct mouthpiece.

SUMMARY OF THE INVENTION

The present invention is a mouthpiece for smoking instruments which is structured to be anatomically correct, in that it is structurally compatible with the mouth parts of a smoker when the mouthpiece is situated in the smoker's mouth at one side thereof.

The mouthpiece according to the present invention is anatomically correct for comfortable placement at the side of the mouth because is has a laterally asymmetrical structure which conforms to the shape of the side of the mouth. More particularly, the tip is acutely angled in relation to the mouthpiece axis which provides a lateral asymmetry having two benefits over conventional mouthpieces when the mouthpiece according to the present invention is placed to one side of the mouth: 1) the tip does not interferingly affront the tongue and cheek, thereby increasing comfort and teeth feel; and 2) the port is directed toward the tongue cavity thereby making inhalation easier and more efficient. Further, while the mouthpiece is laterally asymmetrical, it is vertically symmetrical so that by simply inverting the mouthpiece, it can be placed comfortably at either side of a smoker's mouth.

To further enhance the anatomical correctness of the mouthpiece according to the present invention, it is preferred to include a groove adjacent the tip of the mouthpiece for interfacingly receiving with the biting surfaces of the smoker's teeth (preferably, the eyetooth (or canine) and the first and second bicuspids (or premolars)). It is further preferred to provide the mouthpiece with a concave recess on the side thereof opposite the tip for comfortably interfacing with a smoker's lip and cheek at the side of the mouth.

Accordingly, it is an object of the present invention to provide an anatomically correct mouthpiece.

It is an additional object of the present invention to provide an anatomically correct mouthpiece for smoking instruments, such as cigar holders, cigarette holders and pipes.

It is a further object of the present invention to provide an anatomically correct mouthpiece, in that the tip thereof is angled acutely with respect to the mouthpiece axis.

It is another object of the present invention to provide an anatomically correct mouthpiece which is comfortable with respect to the mouth parts of a user when the mouthpiece is placed at either side of the mouth.

These, and additional objects, advantages, features and benefits of the present invention will become apparent from the following specification.

BRIEF DESCRIPTION OF THE DRAWINGS

FIG. 3 is a perspective view of the mouthpiece according to the present invention, seen in operation integrated with a cigar holder, which is, in turn, holding a cigar.

DETAILED DESCRIPTION OF THE PREFERRED EMBODIMENT

Referring now to FIGS. 2 through 10, the anatomically correct mouthpiece 100 according to the present invention will be described. Throughout the various examples thereof, like numerals designate like functioning parts.

Figure 2:
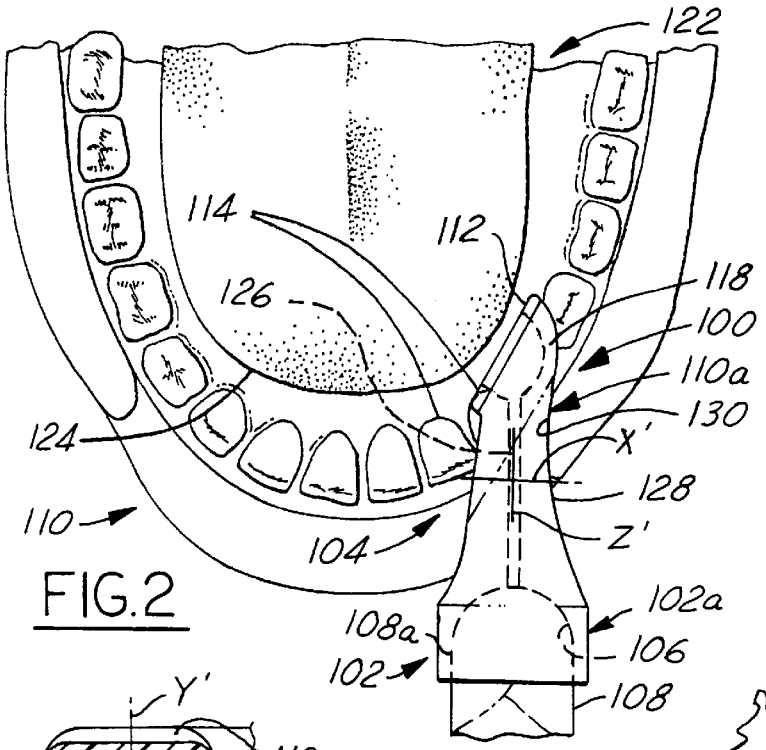
FIG. 2 is a plan view of the mouthpiece according to the present invention, seen in operation integrated with a cigar holder and placed at the side of a smoker's mouth.
Figure 1A:
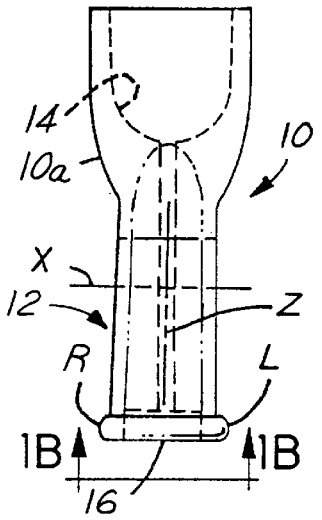
(PRIOR ART) FIG.1A
FIG. 1A is a plan elevational view of a prior art cigar holder.
Figure 3A:
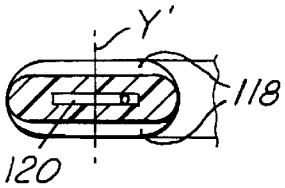
FIG. 3A is a partly sectional end view of the mouthpiece of FIG. 3, seen along line 3A—3A in FIG. 3.
Figure 1B:
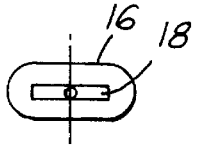
(PRIOR ART) FIG.1B
FIG. 1B is an end view of the prior art cigar holder, seen along line 1B—1B in FIG. 1A.

The anatomically correct mouthpiece 100 according to the present invention will firstly be described with respect to a mouthpiece 100*a* of a smoking instrument in the form of a cigar holder 102, as depicted at FIGS. 2 and 3.

The cigar holder 102 has a holder body 102*a* which has formed at a forward end thereof a cigar receptacle 106. An end 108*a* of a cigar 108 is shown received into the cigar receptacle 106. The mouthpiece 100*a* has a mouthpiece body 104 that is integral with the holder body 102*a* of the cigar holder 102, and is located opposite the cigar receptacle 106.

The mouthpiece 100*a* has a laterally asymmetrical configuration along the lateral axis X' which allows for conformance to the shape of the mouthparts at the side of a smoker's mouth 110. In this regard, as shown at FIG. 2, the mouthpiece body 104 ends at a tip 112 which is acutely angled in relation to the mouthpiece axis Z' so as to be more-or-less parallel with the alignment of the teeth 114 at the side of the mouth 110. The lateral asymmetry of the tip 112 provides for general conforming fit with the teeth 114 so that they mesh well with the mouthpiece 100*a* adjacent the tip. This tooth engagement harmony with the mouthpiece provides an excellent tooth feel, as well as excellent holding control of the mouthpiece by the maxillary and mandibular sets of teeth biting compatibly onto the mouthpiece adjacent the tip. The teeth most preferred to bite upon the mouthpiece are the eyetooth (or canine) and the first and second bicuspids (or premolars) of each of the maxillary and mandibular sets of teeth. In this regard, it is preferred to include a groove 118 adjacent and generally parallel to the tip 112 which serves to receive the biting surf aces of the teeth 114.

Because the tip 112 is acutely angled with the mouthpiece axis Z', the port 120 of the tip is oriented so as to be directly facing, and inside, the tongue cavity 122 of the smoker's mouth. This feature provides for a very direct passageway for smoke from the port 120 to the mouth cavity 122 when the smoker inhales. Further, and very importantly, as shown at FIG. 2, the smoker's tongue 124 is not in any way pressed against by either the left or right sides L', R' of the tip 112. Indeed, the tip 112 is at an angle which is generally parallel with the local tangent to the curvature of the tongue 124. Therefore, the tongue 124 very comfortably accepts the presence of the tip 112 in the mouth 116 without any discomfort. Indeed, the feel is very comfortable.

Internally to the bodies 102*a*, 104, a passageway 126 is provided which communicates between the cigar receptacle 106 and the port 120 of the tip 112.

It is preferred for the comfort of the smoker to be even further enhanced by the mouthpiece 100*a* having an external concave recess 128 which is located opposite to the tip 112. In operation, when the mouthpiece 100*a* is located at one side of the mouth 110, that mouth side 130 of the smoker is pressed against by the mouthpiece in a compressive manner. Thus, to alleviate this mouth compression, the concave recess 128 is provided which relieves compression at the mouth side 130.

While the mouthpiece 100*a* is laterally asymmetrical along the lateral axis X' (see FIG. 2), the mouthpiece is vertically symmetrical along the vertical axis Y' (see FIGS. 3 and 3A) so that by simply inverting the mouthpiece (ie., turning it over 180 degrees), it can be placed in the manner of FIG. 2 at either side of a smoker's mouth 116. In this regard, the concave recess 128 similarly is operative at either side of the smoker's mouth 110.

In operation, the smoker would place the end of a cigar into the cigar receptacle. The smoker would then place the mouthpiece 100*a* into his or her mouth, at what ever side thereof is desired, with the mouthpiece rotated into a position whereat the tip 112 is in general alignment with the teeth and faces toward the mouth cavity 122. The smoker will now be able to comfortably close his or her lips onto the mouthpiece and the compressed side of the mouth will be comfortably received into the concave recess. Further, the teeth of the smoker will compatibly bite onto the groove adjacent the tip with very good hold and very good feel. The smoker now can inhale and tobacco smoke will pass directly and unobstructively from the portal into the mouth cavity.

Figure 4:
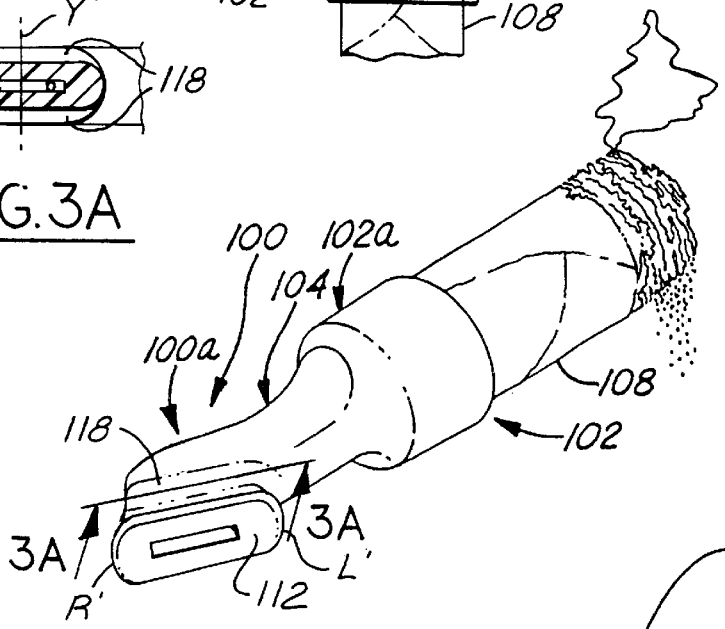
FIG. 4 is a partly sectional view, showing the mouthpiece according to the present invention, seen in operation integrated with a pipe.
Figure 4:
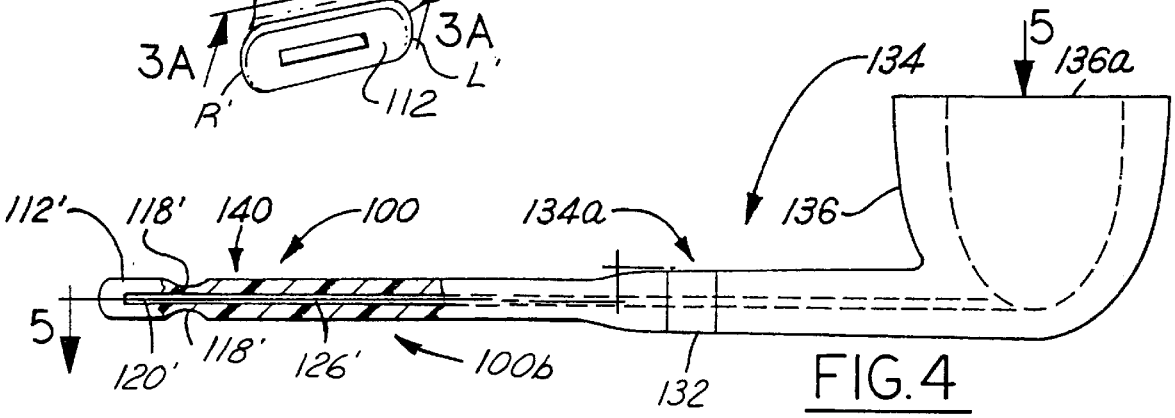
Figure 5:
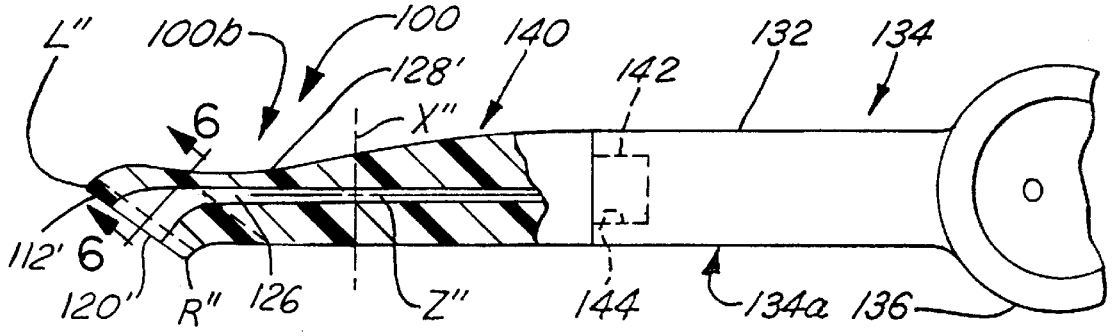
FIG. 5 is a broken away, partly sectional view, showing the mouthpiece according to the present invention, seen in operation integrated with a pipe, as seen along line 5—5 in FIG. 4.
Figure 6:
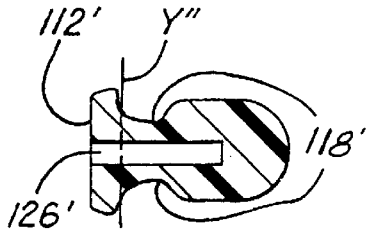
FIG. 6 is a detail sectional view of a tip of the mouthpiece of FIGS. 4 and 5, seen along line 6—6 in FIG. 5.

Turning now to FIGS. 4 through 6, the anatomically correct mouthpiece 100 will be described with respect to a mouthpiece 100*b* for a smoking instrument in the form of a pipe 134.

The pipe 134 has a pipe body 134*a* which includes a pipe stem 132 and a bowl 136, wherein the pipe stem is integral with the bowl. The bowl 136 has an opening 136*a* and is shaped for holding tobacco. The mouthpiece 100*b* has a mouthpiece body 140 which is connected with the pipe body 134*a* at the stem 132 remote from the bowl 136.

The pipe may be one piece, integrally including the mouthpiece 100*b*, in which case the pipe is manufactured either as a left handed pipe (for placement at the left side of the mouth) or a right handed pipe (for placement at the right side of the mouth). Alternatively, the pipe may be two pieced, wherein the mouthpiece 100*b* is not integral with the pipe. An example of a two piece pipe is shown at FIG. 5. The mouthpiece 100*b* is rotatably connected with the stem 132, and is, most preferably, removable therefrom. The mouthpiece 100*b* is rotatable with, and removable from, the stem 132 via the mouthpiece body 140 having a boss 142 which frictionally engages receivably into a socket 144 of the pipe body 134*a*. This rotative feature is important to allow the mouthpiece to be rotated relative to the bowl 136 so that the mouthpiece can be placed at either side of the smoker's mouth and yet always the bowl is upright. Removability of the mouthpiece from the stem allows for periodic replacement of mouthpiece 100*b*.

As in the mouthpiece 100*a*, the mouthpiece 100*b* has a laterally asymmetrical configuration along the lateral axis X" of the mouthpiece 100*b* which allows for conformance to the shape of the mouthparts at the side of a smoker's mouth. In this regard, as shown at FIG. 5, the tip 112' of the mouthpiece body 140 is acutely angled in relation to the mouthpiece axis Z" so as to be more-or-less parallel with the alignment of the teeth at the side of the smoker's mouth. The lateral asymmetry of the tip 112' therefore provides for the teeth of the smoker to mesh well with the mouthpiece 100*b* adjacent the tip. As mentioned hereinabove, this provides an excellent tooth feel, as well as excellent holding control of the mouthpiece by the maxillary and mandibular sets of teeth biting compatibly onto the mouthpiece adjacent the tip. In this regard, it is preferred to include a groove 118' adjacent and generally parallel to to tip 112, which serves to receive the biting surfaces of the smoker's teeth.

As mentioned, because the tip 112' is acutely angled with the mouthpiece axis Z", the port 120' of the tip is oriented so as to be directly facing and inside the mouth cavity of the smoker's mouth. This feature provides for a very direct passageway for smoke from the port 120' to the mouth cavity of the smoker when the smoker inhales. Further, as is the case with the mouthpiece 100*a*, the smoker's tongue will not in any way be pressed against by either the left or right sides L", R" of the tip 112' because the tip is at an angle which is generally parallel with the local tangent to the curvature of the tongue. Therefore, the tongue will very comfortably tolerate the presence of the tip 112 in the smoker's mouth without any discomfort. Indeed, the feel is very comfortable.

Internally to the pipe 134, a passageway 126' is provided which communicates between the bowl 136 and the port 120' of the tip 112'.

It is preferred for the comfort of the smoker to be even further enhanced by the mouthpiece 100*b* having an external concave recess 128' opposite to the tip 112'. In the event the stem 132 and the mouthpiece 100*b* are of relatively thin cross-section, the concave recess 128' may be omitted, since mouth compression is so small that it will not be uncomfortable. As discussed hereinabove, the concave recess 128', where used, serves to alleviate mouth side compression.

While the mouthpiece 100*b* is laterally asymmetrical along the lateral axis X" (see FIG. 5), the mouthpiece is vertically symmetrical along the vertical axis Y" (see FIG. 6). If the pipe is two pieced, by simply inverting the mouthpiece (ie., turning it over 180 degrees), it can be placed to the either side of the mouth (in the general manner of FIG. 2) and the concave recess 128' similarly is operative at either side of the smoker's mouth.

In operation, the smoker, if he or she has a two piece pipe, further adjusts the mouthpiece 100*b* so that the port 120' of the tip 112' faces in the lateral axis X" (ie., is perpendicular to the opening 136*a* of the bowl 136). The smoker then fills the bowl with tobacco. The smoker then places the mouthpiece 100*b* into his or her mouth. In this regard, the side of the mouthpiece axis Z" that the tip 112" is located at determines which side of the smoker's mouth to place the mouthpiece. If the smoker has a two piece pipe, by rotating the mouthpiece relative to the bowl, either side of the mouth is usable, wherein in each case he tip (and port thereof) is rotated so as to be perpendicular to the opening of the bowl. In FIG. 5, for example, the tip is oriented such that a smoker would use his or her left side of the mouth. The smoker will now be able to comfortably close his or her lips onto the mouthpiece and the compressed side of the mouth will be comfortably received into the concave recess. Further, the teeth of the smoker will compatibly bite onto the mouthpiece adjacent the tip with very good hold and very good feel. The smoker now can inhale and tobacco smoke will pass directly and unobstructively from the portal into the tongue cavity. Where the smoker has a two piece pipe, the side of the mouth at which the mouthpiece is located can be changed, each change involving a rotation of the mouthpiece 180 degrees.

Figure 7:
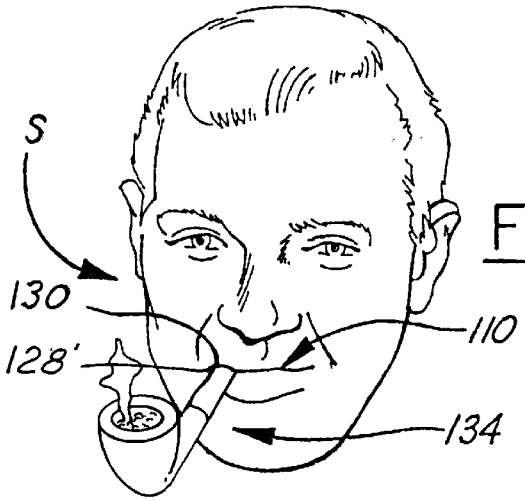
FIG. 7 is a perspective view of a smoker smoking a pipe provided with the mouthpiece according to the present invention.

FIG. 7 depicts a smoker S with a pipe 134 in his mouth 110, showing the concave recess 128' in operation with respect to the side 130 of the mouth.

Figure 9:
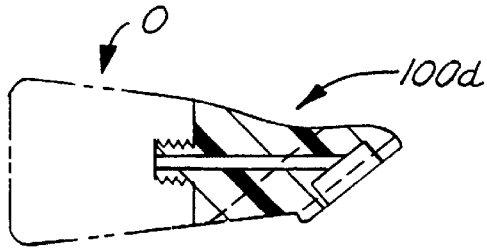
FIG. 9 is a partly sectional view of the mouthpiece according to the present invention, seen in operation frictionally integrated with an object, shown in phantom.
Figure 8:
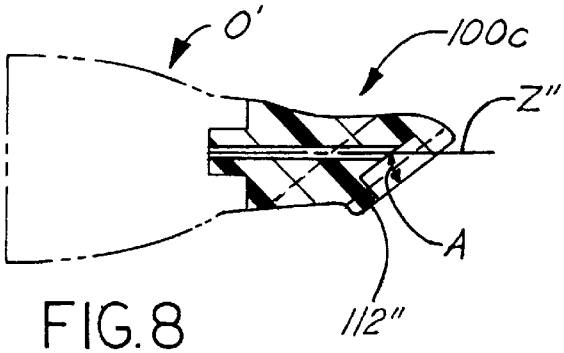
FIG. 8 is a partly sectional view of the mouthpiece according to the present invention, seen in operation threadingly integrated with an object, shown in phantom.

FIGS. 8 and 9 show in phantom objects O, O' connected with respective mouthpieces 100*c*, 100*d*. While the objects may be cigar holders, they may be any other object, such as for example a musical instrument, a medical device or a whistle. In this regard, it is to be noted that the mouthpiece can be used alone or in combination with any object, with or without an internal passageway, integrally connected or removably connected therewith.

Figure 10:
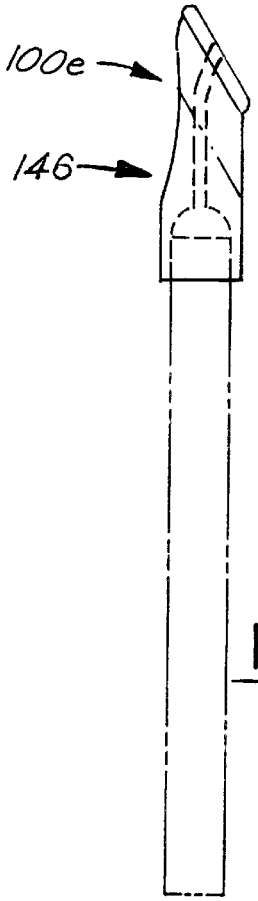
FIG. 10 is a plan view of the mouthpiece according to the present invention, seen in operation integrated with a cigarette holder, which is, in turn, holding a cigarette.

FIG. 10 depicts a smoking instrument in the form of a cigarette holder 146 and mouthpiece 100*e* therefor. The mouthpiece 100*e* is structured and functions as indicated hereinabove at FIGS. 2 and 3 for the mouthpiece 100*a*, and therefore any further discussion would be redundant. What is notable, however, is that the cross-section of a cigarette holder is much slimmer than that of a cigar holder, so that there may be no need for a concave recess, although, this could be present if desired. In FIG. 10, a shallow concave recess is shown.

Considerations concerning the acute angle of the tip relative to the mouthpiece axis will now be discussed. An example of the acute angle A of the tip 112" relative to the mouthpiece axis Z" is depicted at FIG. 8. A preferred range of the acute angle A is between about 10 and 70 degrees, most preferably between about 20 and 50 degrees. The acute angle A can be any acute angle, that is, an angle between zero degrees and less than 90 degrees. The chosen acute angle A depends upon, where in the mouth the user's teeth will bite upon the mouthpiece. For example, where the mouthpiece is bitten upon by the eyetooth and the first and second bicuspids (which is preferred), an acute angle A of about between 35 and 45 degrees may be used. Where the mouthpiece is bitten upon by molars, then the acute angle A would be smaller, such as for example around 20 to 10 degrees or even less. Where the mouthpiece is bitten upon by lateral incisors, the acute angle would be larger, such as for example around 60 to 70 degrees degrees or even more.

Further, the groove can be of any general shape (ie., straight or curved, V-shaped, U-shaped or otherwise shaped), any width and any orientation to thereby comfortably receive the intended teeth of the user of the mouthpiece, whereupon the adjacency of the groove to the tip may be closer or further as a particularly designed tip may best require.

Still further, the concave recess preferably would be deeper when the cross-section of the mouthpiece is wide, and be shallower when the cross-section of the mouthpiece is narrow.

To those skilled in the art to which this invention appertains, the above described preferred embodiment may be subject to change or modification. Such change or modification can be carried out without departing from the scope of the invention, which is intended to be limited only by the scope of the appended claims.

What is claimed is:

1. A mouthpiece comprising:

a mouthpiece body having a mouthpiece axis, a lateral axis being perpendicular to said mouthpiece axis, a vertical axis being perpendicular to said mouthpiece axis and said lateral axis; and a tip integral with said mouthpiece body, said tip being acutely angled with respect to said mouthpiece axis and said lateral axis;

wherein said mouthpiece adjacent said tip has a first width along said vertical axis and a second width perpendicular to said vertical axis, said second width being greater than said first width;

wherein said mouthpiece body has surface means substantially adjacent said tip and generally parallel to a plane formed by intersection of said lateral and mouthpiece axes for being engaged by opposing maxillary and mandibular teeth at the canines and rearward thereof;

wherein said mouthpiece body is asymmetrical along said lateral axis.

2. The mouthpiece of claim 1, wherein said acute angle is between substantially 10 and 70 degrees.

3. The mouthpiece of claim 1, wherein said mouthpiece body is symmetrical along said vertical axis.

4. The mouthpiece of claim 3, further comprising a concave recess formed in said mouthpiece body opposite said tip.

5. The mouthpiece of claim 3, further comprising a groove formed in said mouthpiece body adjacent said tip.

6. The mouthpiece of claim 5, further comprising a concave recess formed in said mouthpiece body opposite said tip.

7. The mouthpiece of claim 6, wherein said acute angle is between substantially 10 and 70 degrees.

8. A smoking instrument comprising:

body means for holding tobacco;

a mouthpiece having a mouthpiece axis, a lateral axis being perpendicular to said mouthpiece axis, a vertical axis being perpendicular to said mouthpiece axis and said lateral axis, said mouthpiece having a tip, said tip being acutely angled with respect to said mouthpiece axis and said lateral axis, wherein said mouthpiece adjacent said tip has a first width along said vertical axis and a second width perpendicular to said vertical axis, said second width being greater than said first width, wherein said mouthpiece body has surface means substantially adjacent said tip and generally parallel to a plane formed by intersection of said lateral and mouthpiece axes for being engaged by opposing maxillary and mandibular teeth at the canines and rearward thereof, wherein said mouthpiece is asymmetrical along said lateral axis;

interconnection means for connecting said mouthpiece to said body means; and passageway means for providing a pathway for smoke from said body means to said tip.

9. The smoking instrument of claim 8, wherein said acute angle is between substantially 10 and 70 degrees.

10. The smoking instrument of claim 9, wherein said mouthpiece body is symmetrical along said vertical axis.

11. The smoking instrument of claim 10, wherein said body means comprises a cigar holder.

12. The smoking instrument of claim 10, wherein said body means comprises a cigarette holder.

13. The smoking instrument of claim 10, wherein said body comprises a pipe.

14. The smoking instrument of claim 10, further comprising a concave recess formed in said mouthpiece body opposite said tip.

15. The smoking instrument of claim 10, further comprising a groove formed in said mouthpiece body adjacent said tip.

16. A smoking instrument comprising:

a cigar holder, said cigar holder having receptacle means for receiving an end of a cigar;

a mouthpiece having a mouthpiece axis, a lateral axis being perpendicular to said mouthpiece axis, a vertical axis being perpendicular to said mouthpiece axis and said lateral axis, said mouthpiece having a tip, said tip being acutely angled with respect to said mouthpiece axis and said lateral axis, wherein said mouthpiece adjacent said tip has a first width along said vertical axis and a second width perpendicular to said vertical axis, said second width being greater than said first width, wherein said mouthpiece body has surface means substantially adjacent said tip and generally parallel to a plane formed by intersection of said lateral and mouthpiece axes for being engaged by opposing maxillary and mandibular teeth at the canines and rearward thereof, wherein said mouthpiece is asymmetrical along said lateral axis;

interconnection means for connecting said mouthpiece to said cigar holder; and passageway means for providing a pathway for smoke from said receptacle means to said tip.

17. The smoking instrument of claim 16, further comprising:

a concave recess formed in said mouthpiece body opposite said tip; and a groove formed in said mouthpiece body adjacent said tip.

18. A smoking instrument comprising:

a pipe, said pipe having a bowl, said bowl having an opening for receiving tobacco into said bowl, said pipe further having a stem connected with said bowl;

a mouthpiece having a mouthpiece axis, a lateral axis being perpendicular to said mouthpiece axis, a vertical axis being perpendicular to said mouthpiece axis and said lateral axis, said mouthpiece having a tip, said tip being acutely angled with respect to said mouthpiece axis and said lateral axis, wherein said mouthpiece adjacent said tip has a first width along said vertical axis and a second width perpendicular to said vertical axis, said second width being greater than said first width, wherein said mouthpiece body has surface means substantially adjacent said tip and generally parallel to a plane formed by intersection of said lateral and mouthpiece axes for being engaged by opposing maxillary and mandibular teeth at the canines and rearward thereof, wherein said mouthpiece is asymmetrical along said lateral axis;

interconnection means for connecting said mouthpiece to said stem; and passageway means for providing a pathway for smoke from said bowl to said tip.

19. The smoking instrument of claim 18, further comprising a concave recess formed in said mouthpiece body opposite said tip.

20. The smoking instrument of claim 18, further comprising a groove formed in said mouthpiece body adjacent said tip.

21. The smoking instrument of claim 18, wherein said interconnection means rotatably connects said mouthpiece to said stem so that said mouthpiece may be selectively rotated at least 180 degrees with respect to said stem.

* * * * *